US011490771B2

(12) United States Patent
Jenkins

(10) Patent No.: US 11,490,771 B2
(45) Date of Patent: Nov. 8, 2022

(54) CLEANING DEVICE

(71) Applicant: Robert Bosch GmbH, Stuttgart (DE)

(72) Inventor: Rhys Jenkins, Ely (GB)

(73) Assignee: Robert Bosch GmbH, Stuttgart (DE)

( * ) Notice: Subject to any disclaimer, the term of this patent is extended or adjusted under 35 U.S.C. 154(b) by 505 days.

(21) Appl. No.: 16/626,228

(22) PCT Filed: Jun. 12, 2018

(86) PCT No.: PCT/EP2018/065481
§ 371 (c)(1),
(2) Date: Dec. 23, 2019

(87) PCT Pub. No.: WO2019/020264
PCT Pub. Date: Jan. 31, 2019

(65) Prior Publication Data

US 2020/0138253 A1 May 7, 2020

(30) Foreign Application Priority Data

Jul. 27, 2017 (DE) ..... 10 2017 007 186.1

(51) Int. Cl.

| | |
|---|---|
| ***A47L 1/05*** | (2006.01) |
| ***A47L 5/24*** | (2006.01) |
| ***A47L 7/00*** | (2006.01) |
| ***A47L 11/40*** | (2006.01) |

(52) U.S. Cl.
CPC ..... *A47L 1/05* (2013.01); *A47L 5/24* (2013.01); *A47L 7/0014* (2013.01); *A47L 11/4044* (2013.01); *A47L 7/00* (2013.01)

(58) Field of Classification Search
CPC . A47L 1/05; A47L 5/24; A47L 7/0014; A47L 11/4044; A47L 7/00; A47L 11/38; A47L 7/0009; A47L 7/0019; A47L 7/0028; A47L 9/0626; A47L 11/30; A47L 1/06
See application file for complete search history.

(56) References Cited

U.S. PATENT DOCUMENTS

| | | | |
|---|---|---|---|
| 3,118,165 | A | 1/1964 | Meyerhoefer |
| 6,047,437 | A | 4/2000 | Suzuki |
| 2004/0221412 | A1 | 11/2004 | Tirkkonen et al. |
| 2012/0266923 | A1 | 10/2012 | Steinhardt et al. |

FOREIGN PATENT DOCUMENTS

| | | | |
|---|---|---|---|
| CA | 2 198 404 | A1 | 8/1998 |
| CA | 2 261 296 | A1 | 8/1999 |
| CN | 2263500 | Y | 10/1997 |
| CN | 203815383 | U | 9/2014 |
| CN | 204889859 | U | 12/2015 |
| CN | 105377099 | A | 3/2016 |

(Continued)

OTHER PUBLICATIONS

International Search Report corresponding to PCT Application No. PCT/EP2018/065481, dated Oct. 4, 2018 (German and English language document) (6 pages).

*Primary Examiner* — David Redding
(74) *Attorney, Agent, or Firm* — Maginot, Moore & Beck LLP

(57) ABSTRACT

A cleaning device, in particular for a cleaning attachment for a hard surface vacuum cleaner, includes at least a first wiper lip and a second wiper lip. A third lip is arranged between the first and second wiper lips so as to space apart the first and second wiper lips.

20 Claims, 7 Drawing Sheets

(56) References Cited

FOREIGN PATENT DOCUMENTS

| | | | |
|---|---|---|---|
| CN | 105392402 | A | 3/2016 |
| CN | 205514344 | U | 8/2016 |
| CN | 105960188 | A | 9/2016 |
| CN | 106793897 | A | 5/2017 |
| CN | 108289576 | A | 7/2018 |
| DE | 26 49 993 | A1 | 5/1978 |
| DE | 10 2008 004 966 | A1 | 7/2009 |
| EP | 2 289 383 | A2 | 3/2011 |
| FR | 2 580 568 | A3 | 10/1986 |
| FR | 2 900 601 | A1 | 11/2007 |
| WO | 94/06342 | A1 | 3/1994 |
| WO | 2017/108088 | A1 | 6/2017 |
| WO | 2017/108089 | A1 | 6/2017 |

a)

b)

CLEANING DEVICE

This application is a 35 U.S.C. § 371 National Stage Application of PCT/EP2018/065481, filed on Jun. 12, 2018, which claims the benefit of priority to Serial No. DE 10 2017 007 186.1, filed on Jul. 27, 2017 in Germany, the disclosures of which are incorporated herein by reference in their entirety.

BACKGROUND

A cleaning device has been disclosed in DE102008004966 A1.

SUMMARY

The disclosure proceeds from a cleaning device, in particular a cleaning attachment for a hard surface vacuum cleaner, for example a vacuum window cleaning device, comprising at least one first and second in particular flexible wiper lip.

It is proposed that a third lip is arranged between the first and second wiper lips in order to space the first and second wiper lips apart. The first wiper lip can also be designated as the upper, the second wiper lip as the lower and the third lip as the middle lip. The third lip can be produced from the same material as the first and second but can also be produced from a different material. When at least the second wiper lip is deformed, so also is the third lip. Streak-free removal from the surface to be cleaned is advantageously made possible, which improves the ease of use and increases the quality of the removal. User friendliness can be improved in this respect. A wide area of application for the device can be ensured. For example, a constantly good take-up of the mixture of air and liquid or streak-free use can be realized in spite of various pressing pressures or deflections of the wiper lips or the lip. Consequently, the device is equally suitable for users who press weakly and users who press firmly. Thus, for example, it is possible to realize a flexibility of the wiper lips of between 1-10 mm with a constant cleaning result. The same is true of various contact angles of the device or of the first wiper lip with reference to the hard surface, for example contact angles of between 40° and 90°, in particular of between 50° and 75°. Production is simple. It is proposed that the wiper lip or the lip comprises a smooth surface and/or is free of elevations. Deflection of the wiper lips or lip and/or flexible adaptation to a surface to be cleaned can easily be effected as a result. The smooth surfaces can easily be moved toward one another. Production costs and expenditure on handling are small. For example, the wiper lips can be continuously produced, for example extruded; intermittent production such as, for example, when producing wiper lips with elevations (demolding) is not necessary but is equally possible.

It is additionally proposed that the first and second wiper lips define a suction nozzle, the opening cross section of which is defined by the third lip or also tongue. The suction nozzle is therefore defined as the opening cross section or open area between the free ends of the first and second wiper lips or the wiper edges thereof. As a result, it is possible to provide an opening cross section that remains constant over the longitudinal extension of the entire suction nozzle so that constant flow conditions and consequently a consistent suction flow or consistent flow speeds can be provided for a fluid to be sucked in, in particular for a mixture of liquid and air.

In addition, it is proposed that, proceeding from its wiper edge, the second wiper lip comprises recesses, in particular slot-shaped recesses, in particular wherein the recesses are arranged at regular intervals along the wiper edge. The slot-shaped recesses extend from the wiper edge or from the free end of the wiper lip toward the clamped end of the wiper lip or in the transverse direction to the wiper edge. As a result, liquid can also be collected in the region of the recesses. Liquid can be sucked away from below the second wiper lip, or between the possible flatly pressed second wiper lip and the hard surface to be cleaned.

It is proposed that the recesses, in particular slots, assume between 5 and 20%, in particular between 8 and 12% of the surface or of the longitudinal extension of the wiper edge. Consequently, at the free end thereof, the wiper edge is interrupted by the recesses in the longitudinal direction. The wiper edge therefore only contacts the hard surface to be cleaned on between 80 and 95% of the cleaning surface. As a result, consistently good cleaning can be advantageously obtained in the various cases of use or application or independently of the user. In particular, a suction flow can be provided in the region of the suction nozzle and from below the second wiper lip. Streak-free and/or residue-free handling can consequently be effected both when removing, that is to say also when lifting the device from the surface to the cleaned.

In addition, it is proposed that the recesses, proceeding from the wiper edge, comprise a depth or extension transversely to the wiper edge of between 50 and 100% of the longitudinal distance between two adjacent recesses. As a result, the aforementioned cases of application can be covered and/or residue-free handing can be achieved.

It is additionally proposed that, proceeding from its free end, the third lip comprises recesses, in particular V-shaped or U-shaped recesses, in particular wherein the recesses are arranged at regular intervals along the lip edge. The recesses taper toward the clamped end of the lip. Complete breakthroughs through the entire thickness or material thickness of the lip are preferred. As a result, even in the case of minimum opening cross sections of the suction nozzle, a suction flow or outflow in the direction of fluid channels in the interior of the device are ensured. Fluid sucked-in in the region of the suction nozzle between first and second wiper lips or the recesses of the second wiper lip or slot, can be transported further into the recesses. Set back with respect to the suction nozzle with the distance between first and second wiper lips increasing or set back from the free ends with respect to the clamping ends of the first and second wiper lips, the flow cross section can be kept as constant as possible by the V-shape or narrowing of the recess and consequently an in particular constant flow speed can be maintained.

It is proposed in addition that the recesses of the third lip assume between 20 and 80%, in particular between 30 and 50%, in a particularly preferred manner around 40% of the surface or of the longitudinal extension of the wiper edge. The longitudinal extension of the third wiper edge typically corresponds to the longitudinal extension of the second wiper edge. The aforenamed positive effects can also be achieved as a result.

It is proposed that the recesses of the second wiper lip are arranged offset to the recesses of the third lip. As a result, the wiper lip or lip define the recesses in the contact surface along the longitudinal direction of the lips or along the free ends. As a result, the suction flow can be guided for maintaining as constant a suction flow as possible and/or a constant or gradual air guiding or air channel cross section.

Furthermore, it is proposed that a free end of the third lip is arranged set back with respect to the free end or to the wiper edge of the first and second wiper lips. In a preferred manner, the free end of the first wiper lip projects beyond the free end of the second wiper lip and the free end of the second wiper lip projects beyond the free end of the third lip. As a result, the flow and suction conditions of the device can be influenced positively in particular in all cases of application. The suction nozzle becoming clogged or the flow coming to a standstill can be avoided.

It is additionally proposed that the thickness of the second wiper lip and/or of the third lip decreases in the region of the free end and/or tapers at an acute angle at least in part toward the free end. As a result, an in particular funnel-shaped suction nozzle can be provided. In addition, an angled or tapered arrangement of the at least adjacent surfaces of the first and second wiper lips or third lip in the region of the suction nozzle or in the region of the free ends of the (wiper) lips can be changed to a substantially parallel or even broadening arrangement in the region of the free ends. As a result, in particular the distance between the first and second wiper lips, in particular in spite of the angled arrangement thereof, can be modified in a direction of extension transversely to the wiper edge (or from the free end to the clamped end) or can be kept constant. This has a positive influence on the suction flow and/or the cleaning quality. The third lip can comprise multiple angles in a transverse direction to the lip edge. In particular, a first angle can predominate on the one side in the region of the spacing between first and second wiper lips and another angle in the following suction channel region. The flow conditions inside the device can also be positively influenced as a result.

It is proposed in addition that the first wiper lip encloses an acute angle with the second wiper lip and/or the third lip, in particular an angle of between 10° and 35°, in a preferred manner an angle of between 20° and 25°. In addition, it is proposed that the second wiper lip is arranged parallel to the third lip. In a preferred manner, the second wiper lip and the third lip abut against one another. Various cases of applications can advantageously be covered. In particular, the device can be operated within a wide spectrum of contact angles with respect to a hard surface and/or with various pressing pressures onto the hard surface.

It is proposed that the angle between the first and second wiper lips and/or the first wiper lip and third lip corresponds at least substantially to the acute angle of the free end of the second wiper lip and/or of the third lip. The aforenamed effects can also be achieved as a result. The distance between the adjacent surfaces of the first and second wiper lips or the first wiper lip and third lip can be kept substantially constant as a result at least in the region of the free ends or can even open slightly toward the wiper edge. As a result, an ideal suction nozzle is formed which ensures good air guidance.

It is additionally proposed that the first wiper lip is held, in a preferred manner is fixed in a non-positive locking manner and/or positive locking manner, in particular so as to be replaceable between a first or upper airflow element and a first housing half shell and/or the second wiper lip is held, in a preferred manner is fixed in a non-positive locking manner and/or positive locking manner, in particular so as to be replaceable between a second or lower airflow element and a second housing half shell. Consequently, one or both wiper lips can be replaced, for example in the case of wear or for use for various hard surfaces etc. In addition, it is possible to clean the device and/or wiper lips as a result of disassembly.

In addition, it is proposed that the third lip is integrally molded on the lower airflow element. As a result, gaps can be avoided, fluid guidance is not impaired and/or soiling of the device can be avoided.

Additionally claimed is a cleaning device, in particular a cleaning attachment, for a hard surface vacuum cleaner, comprising at least one first wiper lip and/or second wiper lip and/or third wiper lip which, in a preferred manner, space(s) the first and second wiper lips apart, wherein at least one wiper lip and/or the lip consist(s) in part of polyethylene. As a result, it is possible to reduce the coefficient of friction between cleaning device and hard surface. Troublesome squeaking noises and/or streak formation are avoided. Removal requires less force. The durability of the cleaning device is increased, its robustness improved. In this case, a wiper lip and/or lip can be coated with polyethylene and/or can include polyethylene in the volume. This can be polyethylene with a high density, with ultra-high molecular weight and/or cross-linked polyethylene. Rubber, for example natural rubber or synthetic rubber, is suitable as base material of the wiper lip or lip. The wiper lip can be coated, for example, with polyethylene powder and extruded, in particular coextruded, or injection molded. When being vulcanized, the polyethylene connects to the rubber in particular as a result of diffusion and/or sintering and/or cross-linking. In a preferred manner, the wiper lips consist at least in part of a rubber or elastomer, for example natural rubber, a synthetic rubber or the like. For example, the first and second wiper lips are produced from EPDM (ethylene propylene diene monomer rubber), in particular coated with PPC (plastic powder coating). For example, the third lip can be formed from a thermoplastic elastomer. The third lip can be integrally molded in an injection molding process on an air guide part, in particular the lower one. Consequently, the wiper lips can be realized in a thinner manner with the same robustness.

Additionally claimed is a hard surface vacuum cleaner, in particular a portable or hand-held hard surface cleaner, having a cleaning device.

Beyond this, a hard surface vacuum cleaner, in particular a hard surface vacuum cleaner having a cleaning device, is claimed, wherein the hard surface vacuum cleaner comprises a handle with a free end, in particular wherein a rechargeable battery is arranged inside the handle. As a result, the hard surface vacuum cleaner can be designed very compactly. The area of application is increased. Where windows are at ground level the removal rod can be extended. In addition, the spectrum of different angles of attack during handling can be enlarged. The center of gravity of the device moves positively. The cleaning attachment tips as it were automatically against the windowpane to be cleaned insofar as it is aligned, as usual, vertically with respect to the ground. In addition, a charging connection for a rechargeable battery can be arranged in the handle, in particular in the region of the free end of the handle. This also increases ease of operation.

Additionally proposed is a hard surface vacuum cleaner, in particular a hard surface vacuum cleaner with a cleaning device, characterized in that a height of the hard surface vacuum cleaner with the applied cleaning attachment is smaller than a longitudinal extension of the cleaning attachment. The longitudinal extension of the cleaning attachment is to be understood as the width thereof transversely to the removal direction. The area of application of the cleaner can also be increased as a result. Where windows are at ground level and/or in corners, the removal rod can be lengthened. In addition, the scope of application of the various angles of attack during handling can be enlarged. The center of gravity of the device moves positively. The cleaning attachment tips as it were automatically against the windowpane to be cleaned insofar as it is aligned, as usual, vertically with respect to the ground. In a preferred manner, the depth to height ratio is >60%, in particular >70%, in a particularly preferred manner is 80%. The depth is to be understood here as the maximum depth extension transversely to the height and width of the hard surface vacuum cleaner; that is to say the distance between the outside surface of the handle and that of the wiper edge of the first wiper lip.

Additionally claimed is a method for sucking in air or a mixture of air and liquid with a cleaning device, in particular with a cleaning attachment of a hard surface vacuum cleaner, wherein the air or the mixture of air and liquid is initially sucked into a suction nozzle formed by a first and second wiper lip, and is then guided through a gap formed by the first wiper lip and a third lip into a suction channel, wherein the third lip spaces at least the free ends of the first and second wiper lips apart, in particular independently of a deflection and/or an angle of attack of the first, second and third (wiper) lips.

BRIEF DESCRIPTION OF THE DRAWINGS

Further advantages are produced from the following description of the drawings. An exemplary embodiment of the disclosure is shown in the drawings. The drawings, the description and the claims include numerous features in combination. In an expedient manner, the person skilled in the art will also look at said features individually and will combine them to form sensible further combinations. Identical parts are designated in the various images with identical reference symbols and for the sake of simplicity are in part not described again.

The figures are as follows.

DETAILED DESCRIPTION

Figure 1:
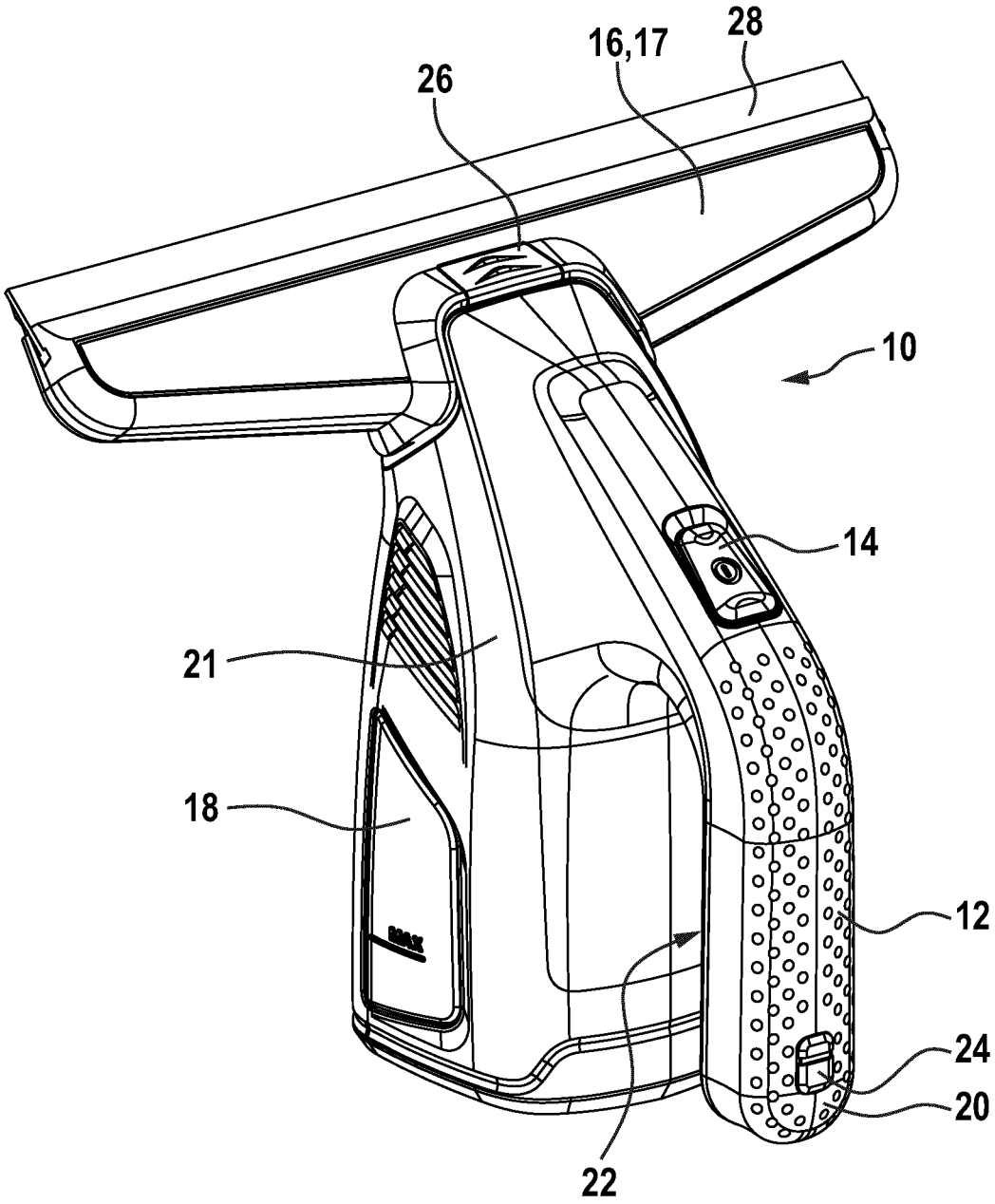
FIG. 1 shows a perspective view of a hard surface vacuum cleaner with a cleaning device or a cleaning attachment.

FIG. 1 shows a schematic representation of a portable hard surface vacuum cleaner 10, by way of which liquid can be sucked away from a hard surface, for example water away from a windowpane. The user is able to hold the hard surface vacuum cleaner 10 by a handle 12 with one hand and can guide it along the hard surface in the manner of a usual wiper comprising a rubber lip. The hard surface vacuum cleaner 10 can be activated via the switch 14 to generate negative pressure at a cleaning attachment 17 or the cleaning device 16. The hard surface vacuum cleaner 10 also comprises a contaminated liquid tank 18. The handle 12 comprises a free end 20. A U-shaped handle opening 22 for encompassing the handle 12 is realized between the handle 12 and a basic housing 21. An interface 24 for recharging an energy supply for the hard surface vacuum cleaner 10 is additionally provided on the handle 12. The cleaning attachment 17 is removable by actuating the fixing device 26 and, by being plugged-on, can be re-applied to the hard surface vacuum cleaner 10. FIG. 1 additionally shows a first or upper wiper lip 28 of the cleaning device 16.

Figure 2:
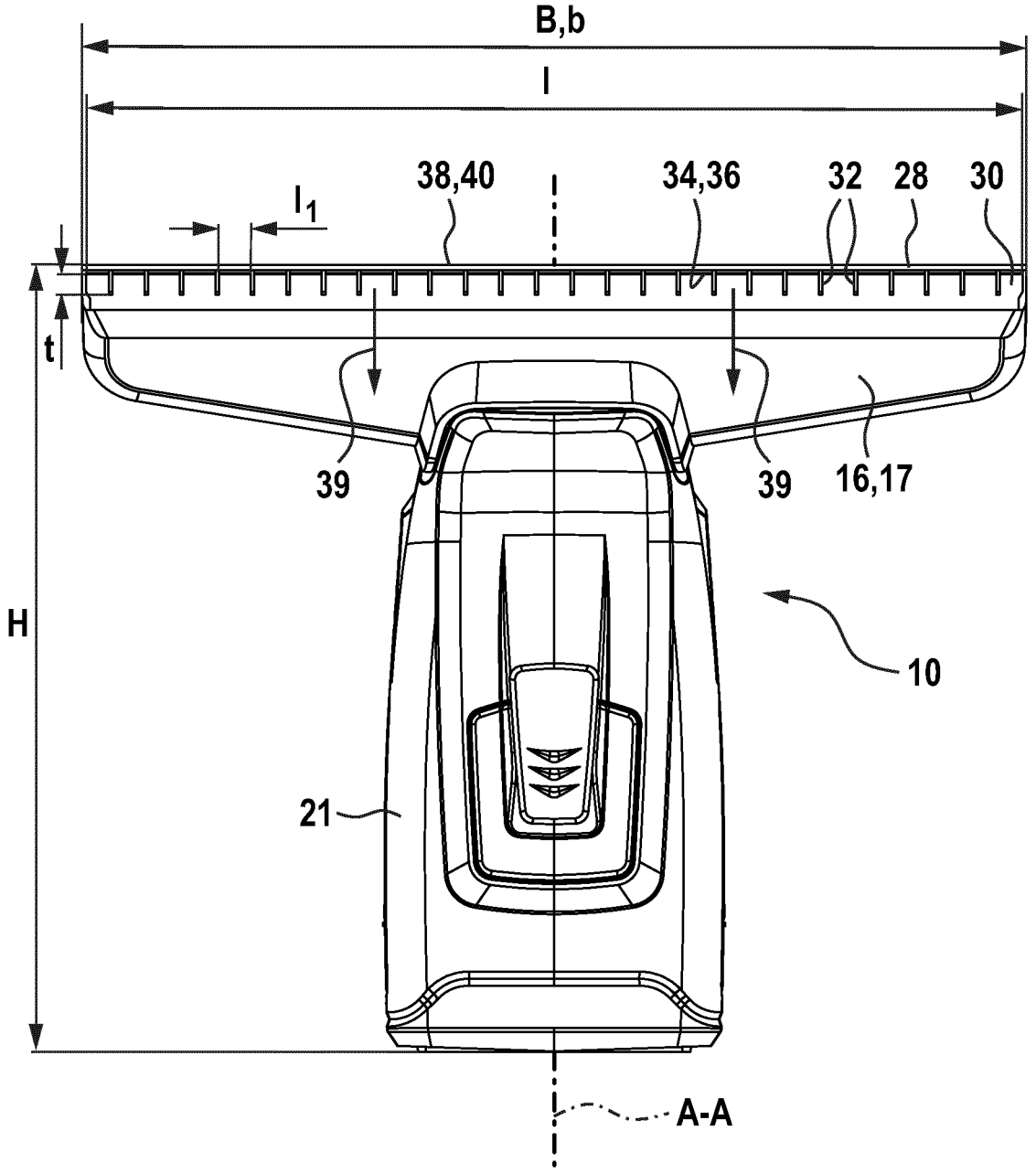
FIG. 2 shows a rear view of the hard surface vacuum cleaner with the cleaning device or the applied cleaning attachment according to FIG. 1.

FIG. 2 provides a rear view of the hard surface vacuum cleaner 10 with the cleaning device 16 or an applied cleaning attachment 17 according to FIG. 1. The cleaning attachment comprises a width b. The first wiper lip 28 extends along said width b. A second or lower wiper lip is additionally shown. The second wiper lip 30 comprises slot-shaped recesses 32. Said slot-shaped recesses are distributed at regular intervals over the second wiper lip 30. The slot-shaped recesses 32 extend from the free end 34 or the wiper edge 36 of the second wiper lip 30 toward the clamped end of the wiper lip (cf. FIG. 3). The second wiper lip comprises a longitudinal extension 1. The recesses 32 assume approximately between 5 and 20%, in the present case approximately between 8 and 12% of the surface of the free end 34 or of the longitudinal extension 1 of the wiper edge 36. In other words, the wiper edge 36 in the present case is interrupted by a recess 32 approximately every 1 mm per centimeter width or longitudinal extension. The depth t or the extension of the recesses 32 proceeding from the wiper edge 36 transversely thereto is approximately between 50 and 100% of the longitudinal distance $l_1$ between two adjacent recesses 32. In addition, the free end 34 of the second wiper lip 30 is projected beyond by a free end 38 or the wiper edge 40 of the first wiper lip 28. The free end 34 of the second wiper lip 30 is arranged set back as it were with respect to the free end 38 of the first wiper lip. A preferred wiping direction for cleaning a surface is shown by the arrows 39.

Figure 3:
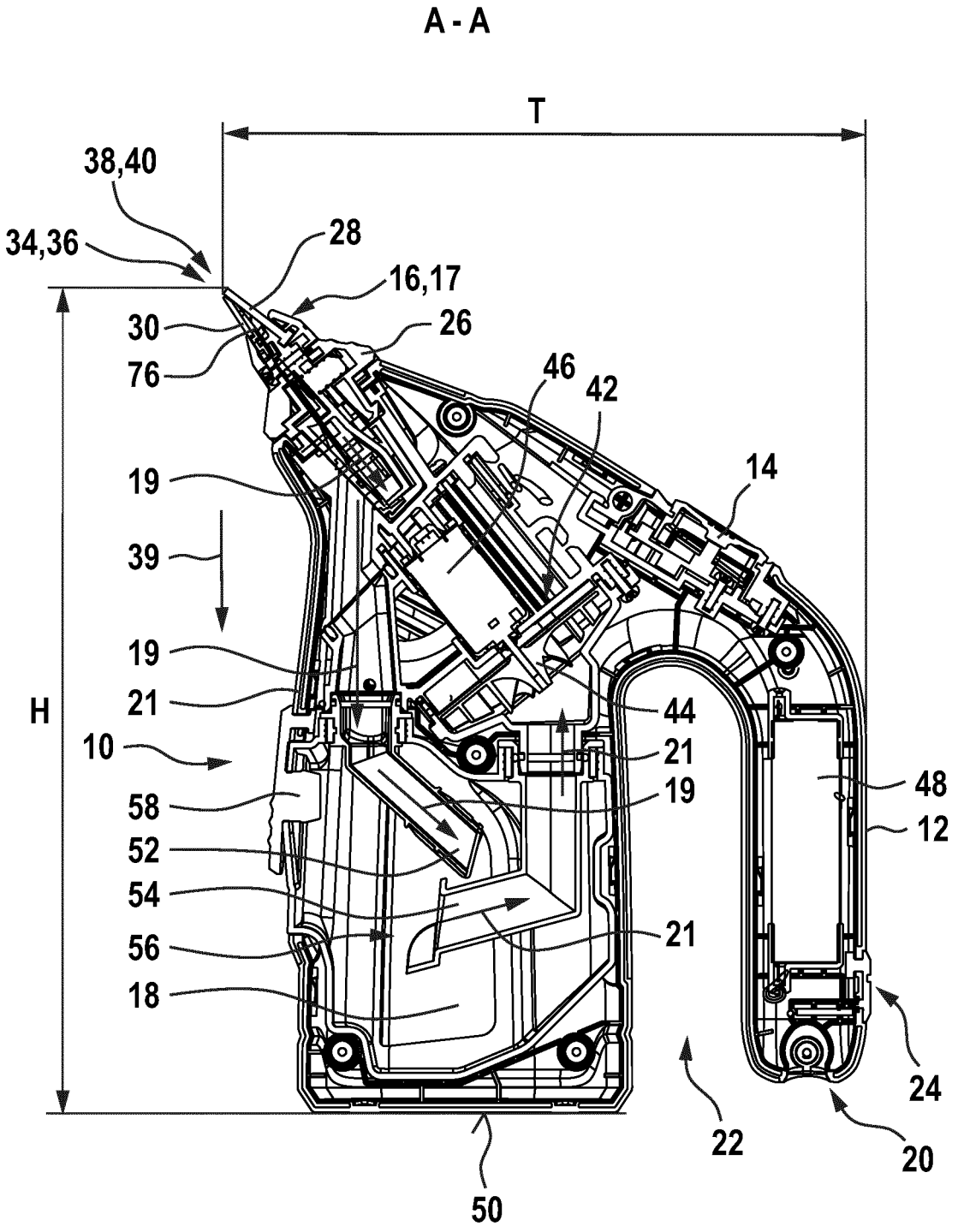
FIG. 3 shows a sectional view of the hard surface vacuum cleaner with the cleaning device or the applied cleaning attachment according to FIG. 1.

FIG. 3 shows a sectional view of the hard surface vacuum cleaner 10 according to FIG. 1 or FIG. 2. The section is made along the line A-A from FIG. 2. The basic housing 21, which also realizes the handle 12, additionally includes a suction unit 42 with a suction blower 44 and a drive motor 46. An energy storage device 48, in particular a lithium ion battery, is arranged inside the handle 12. It supplies the drive motor 46 with power. The bottom of the basic housing 21 forms a standing surface 50 so that the hard surface vacuum cleaner 10 can be positioned in the upright position, as shown in FIGS. 1, 2 and 3, on a standing area. The contaminated liquid tank 18 is arranged in the basic housing 21. An effective separation chamber 56 for the separation or depositing of liquid and air or gas is provided as a result of the arrangement of an outlet channel 52, through which a liquid-air mixture can be conducted from the cleaning attachment 17 in the direction of the arrows 19 into the contaminated liquid tank 18, for the arrangement of a ventilation channel 54, by means of which negative pressure, in relation to the ambient pressure of the hard surface vacuum cleaner 10, can be generated by the suction unit 42 in the contaminated liquid tank 18. The contaminated liquid tank 18 can be emptied via the closable opening 58. The direction of suction of the air or of the gas out of the contaminated liquid tank 18 is shown by the arrow 21.

Figure 4:
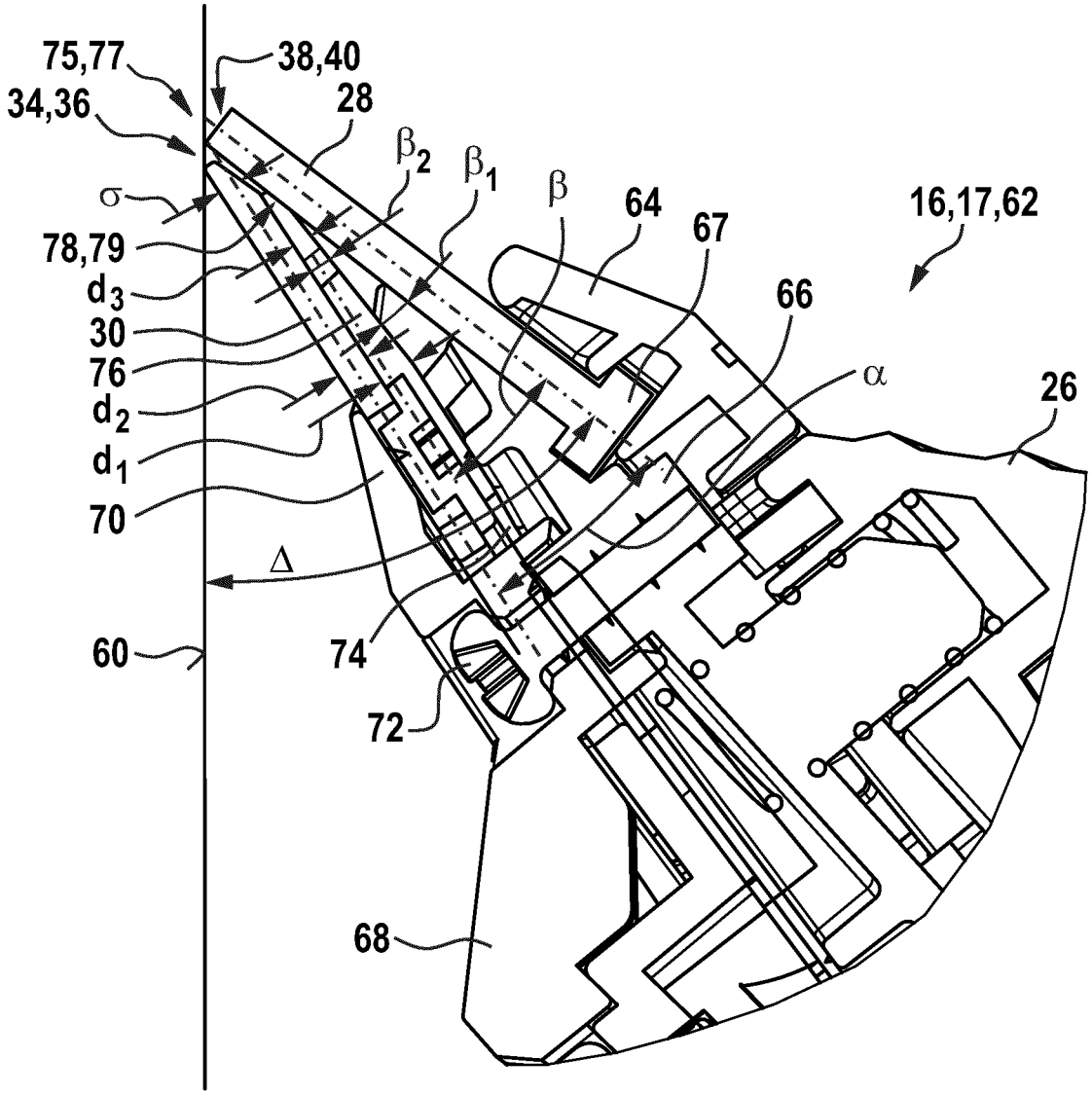
FIG. 4 shows an enlarged sectional view of the cleaning device.
Figure 5:
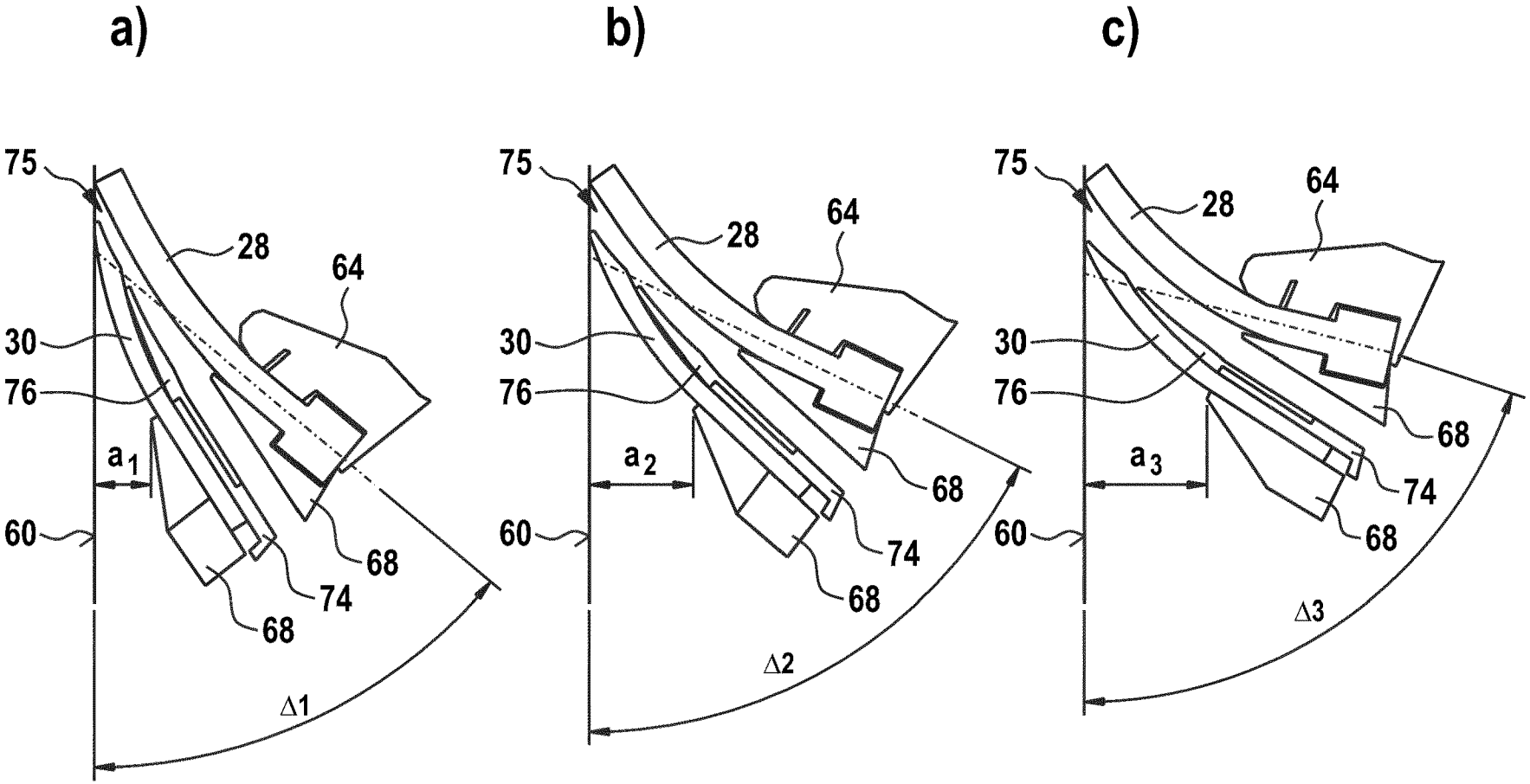
FIG. 5 shows the cleaning device in various cases of application, in particular at various angles of attack with reference to the hard surface.

FIG. 4 shows an enlarged sectional view IV of the cleaning device 16, of the cleaning attachment 17 or of the hard surface vacuum cleaner 10 according to FIG. 3. A hard surface 60 to be cleaned is additionally shown as an example. The cleaning device 16 or the cleaning attachment 17 comprises a housing 62 which is composed of multiple housing parts. The first wiper lip 28, which is flexible, is held so as to be releasable or replaceable between a first or upper half shell 64 and a first airflow element 66. The first wiper lip 28 comprises for this purpose, on its end adjacent the free end 38 or the wiper edge 40, a T-like positive locking element 67. Analogous positive locking elements are realized in the first half shell 64 or the airflow element 66. The second wiper lip 30, which is also flexible, is also held in a preferred manner so as to be replaceable by a second or lower half shell 68 and a clamping strip 70. The clamping strip 70 is connected to the second half shell 68 via fastening means 72. In addition, the clamping means 68 also connect the second half shell 68 to the first half shell 64. The second half shell 68 forms a second airflow element 74. Gas or air, or a mixture of liquid and air from at least the first wiper lip 28 can be transported between the first and second airflow elements 66, 74 in the direction of an outlet of the cleaning attachment 17 or in the direction of the contaminated liquid tank 18. The first airflow element 66 is realized as an insertion part. The space between the first wiper lip 28 and the second wiper lip 30 defines a suction nozzle 75 or a suction opening 77. Air or a mixture of liquid and air is sucked through said suction nozzle 75 into the cleaning attachment 17 (cf. FIG. 5).

In addition, a third or middle lip 76 is arranged between the first and second wiper lips 28, 30. The third lip 76 spaces the first and second wiper lips 28, 30 apart from one another at a distance a (cf. FIG. 7*a*). As a result, the suction nozzle 75 remains open in spite of a vacuum being applied on the side of the airflow elements 66, 74 or the suction channel. In addition, an ideally substantially constantly open suction nozzle 75 can be provided with the wiper lip 28 or the cleaning attachment 17 at a plurality of angles of attack Δ with reference to the hard surface 60 and/or with the wiper lips 28, 30 and/or lip 76 at various deflections d and/or the cleaning attachment 17 at various pressing pressures onto the hard surface 60.

Both the first and second wiper lips 28, 30 can at least, or rest on opposite sides of the lip 76. The third lip 76 is integrally molded in a preferred manner on the second half shell 68. It is produced in a preferred manner with the second half shell 68 from at least two components in a common injection-molded part or the like. However, it can also be connected in another manner to the cleaning attachment 17 or to the second half shell 68, for example in a substance-to-substance bond, in a positive locking manner, in a non-positive locking manner, in a bonded manner or the like. The third lip 76 is aligned substantially parallel to the second wiper lip 30. It abuts substantially flatly against said second wiper lip.

In contrast, the first wiper lip 28 is arranged at an acute angle α to the second wiper lip 30 and/or to the third lip 76, with reference to the free ends thereof 34, 38, 78. In addition, the free end 78 or the edge 79 of the third lip 76 is arranged set back with respect to the free end 34, 38 or the wiper edge 36, 40 of the first and second wiper lips. The free end 38 of the first wiper lip 28 projects beyond the free end 34 of the second wiper lip 30 and the free end 34 of the second wiper lip 30 projects beyond the free end 78 of the third lip 76. In addition, the thickness $t_1$, $t_2$ of the second wiper lip 30 and/or of the third lip 76 decreases in the region of the free ends 34, 78 or tapers at least in part towards the free ends 34, 78. The angle α between the first and second wiper lips 28, 30 and/or between the first wiper lip 28 and the third lip 76 can correspond to the angle of the gradient of the decrease in thickness or of the taper of the second wiper lip 30 and/or of the third lip 76 toward the free ends 34, 78 thereof. In the present case, the angles 8 and a are in the order of the angle α.

FIG. 5*a, b, c* shows a detail of the cleaning attachment 17 with the first and second wiper lips 28, 30 and the third lip 76 at various angles of attack $\Delta_1$, $\Delta_2$, $\Delta_3$ with reference to the hard surface 60. The angles of attack correspond to $\Delta_1$=50°, $\Delta_2$=62.5°, $\Delta_3$=75°, according to FIG. 5*a, b, c*. The distance between the first and second wiper lips 28, 30 increases in dependence on the angle of attack. In addition, by varying the pressing pressure of the cleaning attachment 17 onto the hard surface, the deflection of the first and/or second wiper lips 28, 30 and/or of the third lip 76 can be varied. The admissible deflections or the admissible approximations a of the cleaning attachment 17 are shown below in dependence on the angle of attack. Consequently, for the cases shown according to FIG. 5*a, b, c* with the angles of attack $\Delta_1$=50°, $\Delta_2$=62.5°, $\Delta_3$=75°, an admissible approximation a in mm is produced in order to enable perfect functionality of the cleaning attachment or of the hard surface vacuum device.

| | Δ (degrees) | a min. (mm) | a max. (mm) |
|---|---|---|---|
| a1 | 50° | 1 | 6 |
| a2 | 62.5° | 1 | 8 |
| a3 | 75° | 1 | 10 |

Figure 6:
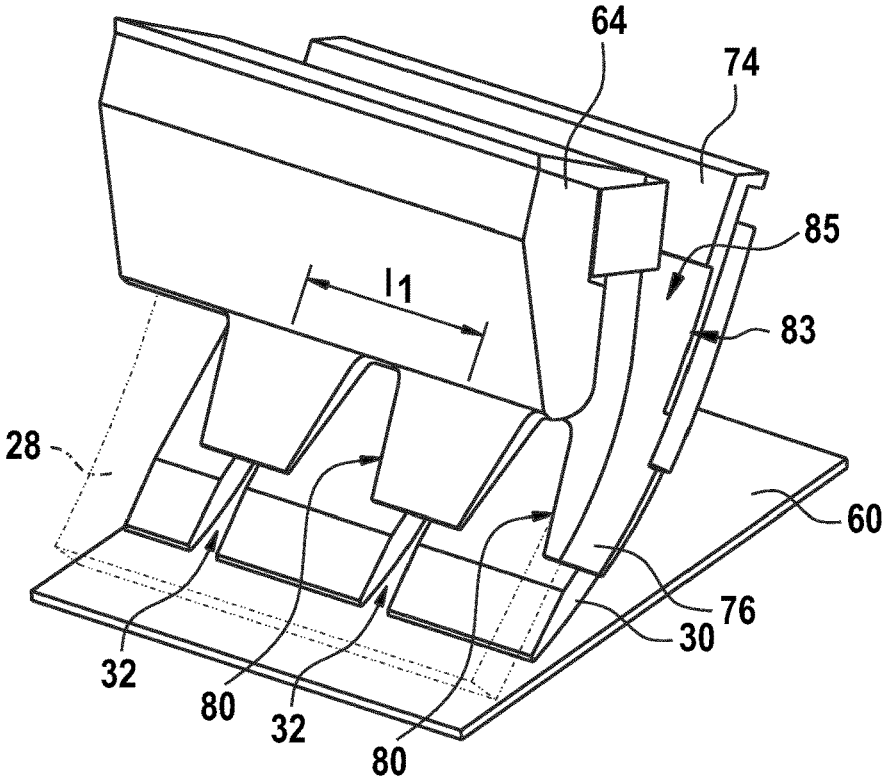
FIG. 6 shows the air flow of the cleaning device in the case of the various cases of application according to FIG. 5.
Figure 6:
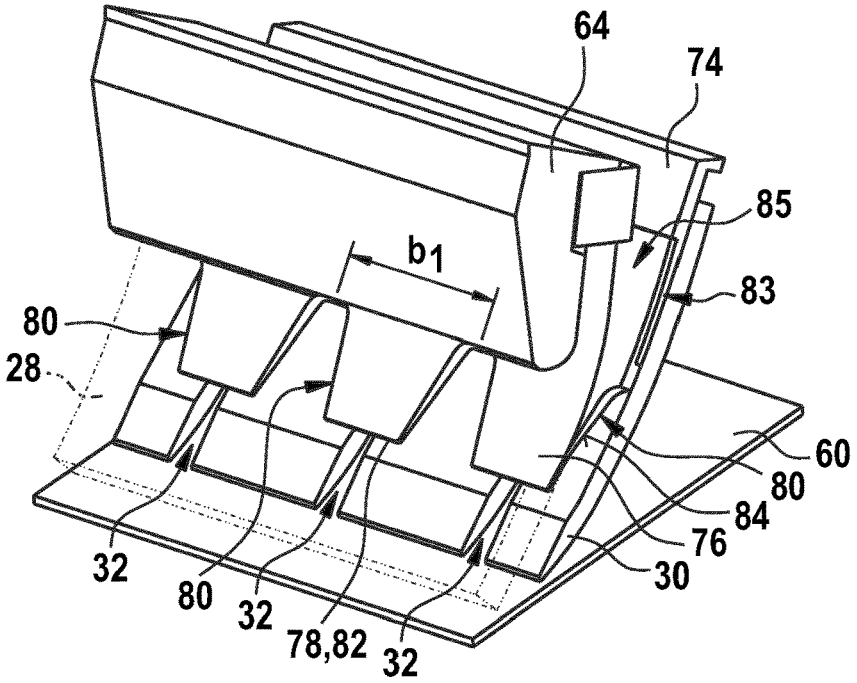

FIG. 6*a, b* shows the arrangement and geometry of the third lip 76, in particular with reference to the first and second wiper lips 28, 30. The third lip 76 comprises recesses 80 proceeding from its free end 78. Said recesses are at least in part V-shaped but can also have a different geometry. The recesses 80 taper proceeding from the free end 78 to the clamped end or become narrower or constricted. The recesses 80 are arranged along the lip edge 82 at regular intervals $b_1$. The recesses 80 of the third lip 76 assume approximately between 30 and 50% of the longitudinal extension of the lip edge 82. Consequently, the lip edge 82 is interrupted, the longitudinal extension of the interruption parallel to the lip edge 82 decreasing in the direction of the integrally molded 83 or fixed end of the third lip 76 as the distance from the lip edge 82 increases. In addition, the recesses 32 of the second wiper lip 30 are arranged offset with respect to the recesses 80 of the third lip 76. The third lip 76 covers the slot 32 of the second wiper lip 30. As the third lip 76 and second wiper lip 30 abut against one another, they define the recesses 32, 80 mutually in the region of the contact surfaces 84 (perpendicularly to the contact surface 84).

The recesses 80 of the third lip 76 are thus therefore also defined by the second wiper lip 30. In addition, the upper or first wiper lip 28 is visible from the T-shaped clamped end or the positive locking element 67 is visible up to the free end 38 or the wiper edge 40. In addition, the second wiper lip 30. The free end 38 of the first wiper lip 28 projects beyond the free end 34 of the second wiper lip 30 and the free end 78 of the third lip 76 is once again arranged set back with respect to the free end 34 of the second wiper lip 30.

Figure 7:
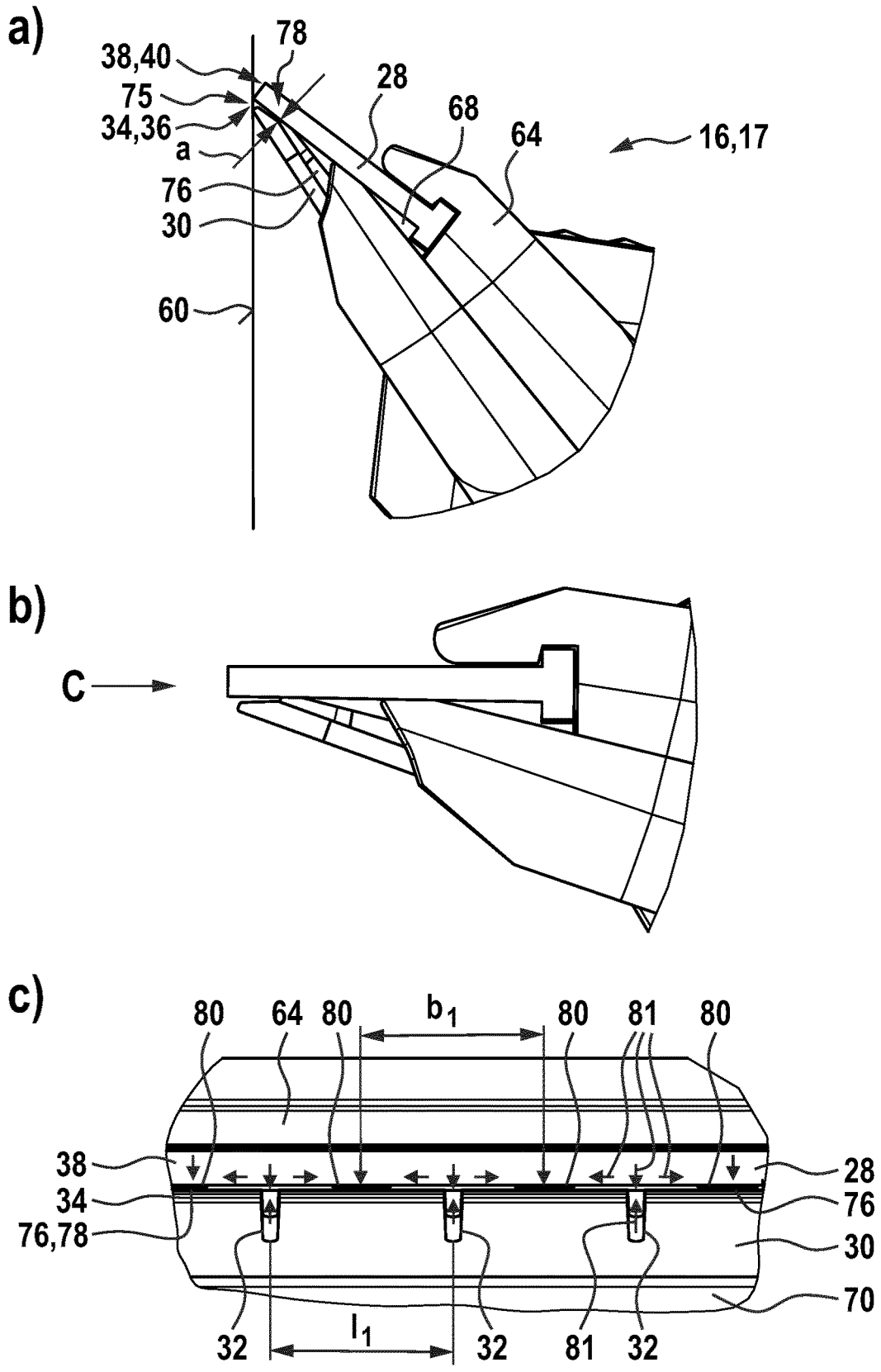
FIG. 7 shows an air flow of the cleaning device.

In addition, FIG. 6*a, b* and FIG. 7*a, b, c* illustrate the method of operation of the cleaning attachment 17 at various deflections of at least the first or second wiper lips 28, 30 and/or of the third lip 76 when placed onto a hard surface 60 or various approximations of the cleaning attachment 17 to a hard surface 60. In this case, a distinction can be made between three cases as examples along with many further intermediate cases. These are: a small, a medium and an excessive deflection of the wiper lip(s) 28, 30 or of the third lip 76. Insofar as a strong deflection is present, a suction air stream, from the rear side, or from the side of the second wiper lip 30 facing the hard surface 60, is sucked via the free end 78 of the third lip 76 into the interior 85 of the cleaning attachment 17. The mixture of liquid and air can collect in the recesses 32 of the second wiper lip 30 and in the region of the suction nozzle 75. It can be sucked away via the free end 78 of the third lip 76, by means of which the cross section of the suction nozzle 75 is defined in said region (and where the thickness of the third lip 76 is low). The flow speed at the suction nozzle 75 and in the region of the slot or recesses 32 can be held at a constantly high level as a result so that good suction of the mixture of liquid and air can be obtained on the hard surface 60.

FIG. 6*b* illustrates a medium deflection of at least the first or second wiper lips 28, 30 and/or of the third lip 76 when placed onto a hard surface 60 or a medium approximation of the cleaning attachment 17 to a hard surface 60. The third or middle lip 76 covers the slot 32 of the second wiper lip 30 at least in part. As a result, the flow speed of the air stream is kept up in particular at the free end or the free ends of the (wiper) lips 28, 30, 76 so that liquid droplets can be captured sufficiently. The suction air stream can also be sucked from the rear side, or the side of the second wiper lip 30 facing the hard surface 60, via the free end 78 of the third lip 76 and sometimes also via the V-shaped recesses 80 into the interior 85 of the cleaning attachment 17. The mixture of liquid and air can collect in the recesses 32 of the second wiper lip 30 and in the region of the suction nozzle 75. It is also sucked away at as constant a flow speed as possible via the free end 78 of the third lip 76 and via the V-shaped recesses 80.

FIG. 7*a, b, c* illustrates the airflow in the region of the suction nozzle 75, in particular in the critical case of the removal of the cleaning attachment 17 from the hard surface 60, in particular when said cleaning attachment is only slightly deflected or approximated to the hard surface 60, or when the cleaning attachment 17 is held freely in the air. FIG. 7*a* shows a detail IV of the cleaning attachment according to FIG. 3 or 4 but in a side view (non-sectioned). When the first or second wiper lips 28, 30 are raised one after another or together from the hard surface 60, to raise them and obtain an at least substantially residue-free or streak-free result, it is helpful when a sufficient negative pressure or a sufficient suction flow remains unchanged at the suction nozzle 75 and/or the suction flow speed is kept as constant as possible. This can be achieved as a result of the third lip 76, in a preferred manner as a result of the aforenamed thickness $d_3$ thereof which decreases in particular toward the free end 78 and/or as a result of the tapering angular position $ß_1$, $ß_2$. FIG. 7*b* illustrates the direction of the view according to FIG. 7*c* of a detail of the suction nozzle 75 or of the free ends 34, 38, 78 of the wiper lips 28, 30 and lip 76. The mixture of liquid and air is sucked away both from below the second wiper lip 30, in particular in the region of the slot 32 or in other words from the side of the second wiper lip 30 facing the hard surface 60, and on the front side and/or lower side of the first wiper lip 28. It is sucked through the slot 32 via the free end 78 of the third lip 76 and into the recesses thereof. This is illustrated by the arrows 81. On account of the small gap size of the suction nozzle 75, the flow speed can remain relatively high so that at least a large part of the liquid remaining when the attachment is raised can be captured by the cleaning attachment 17.

The invention claimed is:

1. A cleaning device, comprising:

at least one first wiper lip and at least one second wiper lip; and a third lip arranged between the first and second wiper lips and configured to space apart the first and second wiper lips.

2. The cleaning device as claimed in claim 1, wherein the first and second wiper lips define a suction nozzle.

3. The cleaning device as claimed in claim 1, wherein, proceeding from a free end or from a wiper edge, the second wiper lip includes recesses arranged along the wiper edge.

4. The cleaning device as claimed in claim 3, wherein the recesses assume between 5 and 20% of a surface or of a longitudinal extension of the wiper edge.

5. The cleaning device as claimed in claim 3, wherein the recesses, proceeding from the wiper edge, have a depth transversely to the wiper edge of between 50 and 100% of a longitudinal distance between two adjacent recesses.

6. The cleaning device as claimed in claim 1, wherein, proceeding from a free end, the third lip includes recesses arranged along the free end of the third lip.

7. The cleaning device as claimed in claim 6, wherein the recesses of the third lip assume between 20 and 80% of a surface or of a longitudinal extension of the free end.

8. The cleaning device as claimed in claim 3, wherein, proceeding from a free end, the third lip includes recesses arranged along the free end of the third lip, and wherein the recesses of the second wiper lip are arranged offset to the recesses of the third lip.

9. The cleaning device as claimed in claim 1, wherein a free end or an edge of the third lip is arranged set back with respect to free ends or to wiper edges of the first and second wiper lips.

10. The cleaning device as claimed in claim 1, wherein one or more of:

a thickness of one or more of the second wiper lip and the third lip decreases toward free ends thereof, and one or more of the second wiper lip and the third lip tapers at an acute angle in the region of the free ends.

11. The cleaning device as claimed in claim 1, wherein the first wiper lip encloses an acute angle with one or more of the second wiper lip and the third lip.

12. The cleaning device as claimed in claim 10, wherein the first wiper lip encloses an acute angle with one or more of the second wiper lip and the third lip, and wherein the acute angle of the first wiper lip corresponds to the acute angle of the free end of the one or more of the second wiper lip and the third lip.

13. The cleaning device as claimed in claim 1, wherein one or more of:

the first wiper lip is fixed in one or more of a non-positive locking manner and a positive locking manner so as to be replaceable between a first or upper airflow element and a first housing half shell, and the second wiper lip is fixed in one or more of a non-positive locking manner and a positive locking manner so as to be replaceable between a second or lower airflow element and a second housing half shell.

14. The cleaning device as claimed in claim 1, wherein the third lip is integrally molded on a lower airflow element.

15. The cleaning device as claimed in claim 1, wherein one or more of (i) at least one of the first and second wiper lips and (ii) the third lip consist(s) at least in part of polyethylene.

16. A hard surface vacuum cleaner, comprising:

a cleaning device including:

at least one first wiper lip and at least one second wiper lip, and a third lip arranged between the first and second wiper lips and configured to space apart the first and second wiper lips.

17. The hard surface vacuum cleaner as claimed in claim 16, further comprising:

a handle with a free end; and a rechargeable energy storage device is arranged inside the handle.

18. The hard surface vacuum cleaner as claimed in claim 16, wherein the cleaning device is configured as a portion of a cleaning attachment that is releasably attached to the hard surface vacuum cleaner, and wherein a height of the hard surface vacuum cleaner with the cleaning attachment attached thereto is smaller than a longitudinal extension or a width of the cleaning attachment.

19. The hard surface vacuum cleaner as claimed in claim 18, wherein one or more of (i) a depth to height ratio is greater than 60%, and (ii) a charging interface configured to recharge the energy storage device is arranged in the handle.

20. A method for sucking air or a mixture of air and liquid into a cleaning device, comprising:

sucking the air or the mixture of air and liquid into a suction nozzle defined by a first wiper lip and a second wiper lip of the cleaning device; and guiding the air or the mixture of air and liquid through a gap defined by the first wiper lip and a third lip of the cleaning device into a suction channel after the air or the mixture of air and liquid is sucked into the suction nozzle, the third lip spacing the first and second wiper lips apart independently of one or more of an angle of deflection and an angle of attack of the first wiper lip, the second wiper lip, and the third lip.

* * * * *